US010391352B2

(12) United States Patent
Meredith et al.

(10) Patent No.: US 10,391,352 B2
(45) Date of Patent: Aug. 27, 2019

(54) TUBE RACK-OUTS FOR USE WITH EXERCISE MACHINE

(71) Applicant: HOIST FITNESS SYSTEMS, INC., Poway, CA (US)

(72) Inventors: Jeffrey Meredith, Del Mar, CA (US); Bruce Hockridge, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 103 days.

(21) Appl. No.: 15/727,971

(22) Filed: Oct. 9, 2017

(65) Prior Publication Data

US 2018/0104527 A1 Apr. 19, 2018

Related U.S. Application Data

(60) Provisional application No. 62/407,623, filed on Oct. 13, 2016.

(51) Int. Cl.
*A63B 21/072* (2006.01)
*A47B 81/00* (2006.01)
(Continued)

(52) U.S. Cl.
CPC ..... *A63B 21/072* (2013.01); *A47B 57/42* (2013.01); *A47B 57/46* (2013.01); *A47B 57/52* (2013.01);
(Continued)

(58) Field of Classification Search
CPC . A63B 21/072; A63B 2209/00; A63B 21/062; A63B 21/0624; A47F 7/143; A47F 5/0876; A47F 7/24; A47F 5/0006; A47F 5/08; A47F 5/0815; A47G 25/0685; A47G 25/0664; A47G 25/06; A47B 57/30; A47B 57/40; A47B 57/48; A47B 57/42;
(Continued)

(56) References Cited

U.S. PATENT DOCUMENTS 2,643,170 A 6/1953 Vanderveld et al.
2,933,196 A * 4/1960 Childs ..... A47B 57/42 211/183

(Continued)

FOREIGN PATENT DOCUMENTS

GB 2181637 A 4/1987

OTHER PUBLICATIONS

International Searching Authority, International Search Report and Written Opinion for International Application No. PCT/US2017/055735, dated Dec. 26, 2017, 7 pages.

*Primary Examiner* — Jennifer E. Novosad
(74) *Attorney, Agent, or Firm* — Gordon Rees Scully Mansukhani LLP; David R. Heckadon

(57) ABSTRACT

A tube rack-out system for use in an exercise machine having: a hollow support structure having an aperture therein; an angled tubular member, the angled tubular member having a first end received into the aperture in the hollow support and a second end that is angled upwardly; and a cover passing over an upper surface of the angled tubular member, the cover being connected onto the hollow support structure. The system enables the mounting of individual rack-outs on a support member and provides a large surface area between the covers and the angled tubular member below the covers, thereby contributing to the long life of the covers.

12 Claims, 4 Drawing Sheets

(51) Int. Cl.

| | |
|---|---|
| ***A47B 57/56*** | (2006.01) |
| ***A47B 96/14*** | (2006.01) |
| ***A47B 57/46*** | (2006.01) |
| ***A47B 57/42*** | (2006.01) |
| ***A47B 96/06*** | (2006.01) |
| ***A47B 57/52*** | (2006.01) |
| ***A63B 71/00*** | (2006.01) |

(52) U.S. Cl.
CPC ..... *A47B 57/56* (2013.01); *A47B 57/562* (2013.01); *A47B 81/00* (2013.01); *A47B 96/061* (2013.01); *A47B 96/067* (2013.01); *A47B 96/068* (2013.01); *A47B 96/1408* (2013.01); *A47B 96/1433* (2013.01); *A63B 71/0036* (2013.01); *A63B 21/0724* (2013.01); *A63B 21/0726* (2013.01); *A63B 2209/00* (2013.01)

(58) Field of Classification Search
CPC ..... A47B 57/44; A47B 57/46; A47B 57/50; A47B 57/52; A47B 57/56; A47B 57/562; A47B 57/567; A47B 57/565; A47B 96/061; A47B 96/067; A47B 96/068; A47B 96/14; A47B 96/1408; A47B 96/1433; A47B 81/00
USPC ..... 482/104, 103; 211/87.01, 106.01, 193, 211/85.7, 192, 191, 190, 100, 101, 196, 211/197, 205; 248/345.1, 452, 453, 248/220.41, 224.8, 225.11, 247, 250
See application file for complete search history.

(56) References Cited

U.S. PATENT DOCUMENTS 2,941,775 A 6/1960 Arnit
3,299,839 A * 1/1967 Nordbak ..... A47B 57/42 108/152
3,468,430 A * 9/1969 Lawman ..... A47F 5/14 211/182
3,606,229 A * 9/1971 Wall ..... A47B 96/061 248/200
3,707,273 A * 12/1972 Bortz ..... A47B 96/061 248/235
3,787,016 A * 1/1974 Laval, Jr. ..... F16L 3/23 211/193
3,888,440 A * 6/1975 Rebentisch ..... A47B 57/42 248/222.13
3,923,277 A * 12/1975 Perrault ..... F16L 3/00 211/196
3,960,275 A * 6/1976 Haughton ..... A47F 5/13 211/182
4,215,784 A * 8/1980 Perkins ..... A47F 5/08 211/105.2
4,372,450 A * 2/1983 Licari ..... A47G 25/0678 211/106.01
4,426,011 A * 1/1984 Jay ..... A47B 57/44 211/182
4,431,155 A * 2/1984 Engel ..... A47B 96/061 108/108
4,474,299 A * 10/1984 Andrews ..... A47F 7/24 211/123
4,527,797 A 7/1985 Slade, Jr. et al.
4,667,935 A * 5/1987 Moore ..... E04F 11/181 256/22
5,011,141 A 4/1991 Towley, III et al.
5,170,898 A * 12/1992 Katz ..... A47B 57/54 211/193
5,253,835 A * 10/1993 Herron, III ..... A47B 57/30 108/108
5,346,448 A 9/1994 Sollo
5,377,849 A * 1/1995 Martin ..... A47F 8/02 211/85.7
5,423,510 A * 6/1995 Almoslino ..... A47B 95/00 248/243
5,472,103 A 12/1995 Merl
5,690,239 A * 11/1997 Ballard ..... A47F 5/04 211/187
5,727,698 A * 3/1998 Lai ..... A47F 7/02 211/87.01
5,826,848 A * 10/1998 Cekosh ..... A47B 96/061 248/345.1
6,019,331 A * 2/2000 Hoogland ..... A47B 96/061 108/108
6,082,690 A * 7/2000 Durin ..... H02G 3/263 211/90.01
6,098,552 A * 8/2000 Gunderson ..... A47B 96/061 108/108
6,196,141 B1 * 3/2001 Herron, III ..... A47B 57/42 108/108
6,371,313 B1 * 4/2002 Walter ..... A47F 5/10 211/105.1
6,422,523 B1 * 7/2002 Weshler ..... A47B 57/402 248/220.22
6,769,656 B1 * 8/2004 Botkin ..... A47F 5/0823 211/57.1
6,786,340 B2 * 9/2004 Ford ..... A47F 5/0815 211/103
6,910,306 B2 * 6/2005 Waalkes ..... A47B 21/06 52/220.7
7,284,671 B1 * 10/2007 Doscher ..... A63B 71/0036 211/59.1
7,353,957 B2 * 4/2008 Winig ..... A47F 5/0815 211/59.1
7,478,785 B2 * 1/2009 Herron, III ..... A47B 57/42 211/187
7,942,747 B2 * 5/2011 Cole ..... A47B 47/00 211/100
8,002,124 B2 * 8/2011 Lin ..... B25H 3/025 206/372
8,016,137 B2 * 9/2011 Shaha ..... A47B 96/061 211/103
8,082,859 B2 * 12/2011 Sevack ..... A47B 96/066 108/152
8,308,116 B2 * 11/2012 Daniels ..... A47G 25/0678 211/106.01
8,540,198 B2 * 9/2013 Keyvanloo ..... A47F 5/0823 248/220.21
8,573,548 B2 * 11/2013 Kuhn ..... A47F 5/0815 248/206.5
8,596,590 B2 * 12/2013 McCoy ..... F16L 3/223 211/193
9,470,041 B2 * 10/2016 Ash ..... E04H 17/1413
9,610,490 B2 * 4/2017 Tambornino ..... A63B 71/0036
10,139,015 B2 * 11/2018 VanValkenburgh ..... F16L 3/02
10,186,850 B1 * 1/2019 O'Regan ..... H02G 9/10
2008/0128373 A1 * 6/2008 Chang ..... A47G 25/0607 211/106.01
2009/0127413 A1 5/2009 Herron, III et al.
2010/0096347 A1 * 4/2010 Theobald ..... B60R 9/06 211/85.7
2010/0213149 A1 8/2010 Shaha

* cited by examiner

TUBE RACK-OUTS FOR USE WITH EXERCISE MACHINE

RELATED APPLICATION

The present application claims priority to U.S. Provisional Patent Application 62/407,623, of same title, filed Oct. 13, 2016, the full disclosure of which is incorporated by reference herein in its entirety for all purposes.

TECHNICAL FIELD

The present system relates to rack-outs for use with weight-lifting exercise machines or weight-lifting bar storage racks.

BACKGROUND OF THE INVENTION

An exercise machine and/or an exercise storage rack may include rack-outs for holding exercise equipment including free weights and/or assisted exercise bars. For example, rack-outs may be used on exercise storage racks for holding free weight equipment such as dumbbells and/or barbells. The use of rack-outs allow users to keep free weight equipment organized and helps to avoid hazards associated with equipment lying around on the floor. Rack-outs may also be used on exercise machines having assisted exercise equipment where exercise bars are physically attached to the exercise machine. In these configurations, use of rack-outs allow a user to rest an assisted bar on the rack-outs when the user is finished using it.

Whether the rack-outs are used for free weights or assisted weights, the rack-outs are subject to wear due to a high frequency of equipment placed on and off of them. Over time this can lead to damage of the covers that are placed over the rack-outs. There are many types of rack-outs on the market today, and they may use different configurations. However, most of them use polyurethane covers positioned over the edges of a laser cut steel plate. Unfortunately, these steel plates typically have high manufacturing costs as they are too thick to stamp out. In addition, these steel plates can often damage the polyurethane covers over time due to the high frequency of equipment placement upon the minimal edge surface area of the steel plates.

Accordingly, the need exists for a new rack-out design that helps to minimize damage to the polyurethane covers. In addition, the need exists for a cost-effective retail price point to allow integration of the rack-out designs into home and/or light commercial exercise machines.

SUMMARY OF THE INVENTION

In a first aspect, the present system provides a weight exercise rack-out support apparatus, comprising: (a) a hollow support structure having an aperture therein; (b) an angled tubular member, the angled tubular member having a first end received into the aperture in the hollow support and a second free end that is angled upwardly; and (c) a cover passing over an upper surface of the angled tubular member, the cover being connected onto the hollow support structure.

In various embodiments, the rectangular cross sections are square cross sections, the hollow support structure is positioned vertically and the angled tubular member projects horizontally away from the hollow support structure.

In various embodiments, the cover has a downwardly shaped curved portion that is received over the upwardly curved free end of the tubular member. The cover may optionally be secured to the hollow support structure with screws.

In other alternate embodiments, the support structure may have a pair of slots on a side opposite to the aperture and the angled tubular member may have end notches that are received into these slots. Preferably, the angled tubular member is welded into the aperture in the support structure, and/or the end notches on the angled tubular member are welded into the slots in the support structure. In further alternate embodiments, an end cap can be disposed over the second aperture in the hollow support structure such that the end cap covers the open first end of the angled tubular member.

The present rack-out system has numerous advantages. First, the present rack-out system adds to the lifetime of an exercise machine and/or exercise equipment storage rack by providing a wide contact area between the cover and the solid top surface of the angled tubular member supporting the cover. This wide contact area helps to prevent tears to the polyurethane covers. Secondly, the present system is more cost effective for home and/or light commercial exercise machines and/or exercise equipment storage racks. This is due to the fact that each angled support member and associated rack-out cover and can be separately attached to the vertical support member. In contrast, existing systems typically use large saw-tooth shaped cut out steel panels that stretch along the full height of the rack-out system. The present system completely advantageously avoids such large saw-tooth shaped laser cut out steel panels.

Also, the present system has rounded surface edges that are less likely to tear the covering materials upon impact with the edges. In addition, the present system offers the benefits of easier and cheaper manufacturing. For example, an angled tubular member as described herein is much easier to bend and cut as compared to a conventional cut-out steel panel rack-out configuration. In a conventional rack-out configuration, the rack-outs are usually formed thick plates that may be 0.5 inches thick and must be laser cut as they are too thick to stamp out. In the above examples, the tubes are cheaper, easier to manufacture, better for maintaining covers, and may be used with home exercise equipment, and larger or smaller commercial equipment.

This Summary is provided to introduce a selection of concepts in a simplified form that are further described below in the Detailed Description. This Summary is not intended to identify key features or essential features of the subject matter, nor is it intended to be used as an aid in determining the scope of the subject matter.

Figure 2:
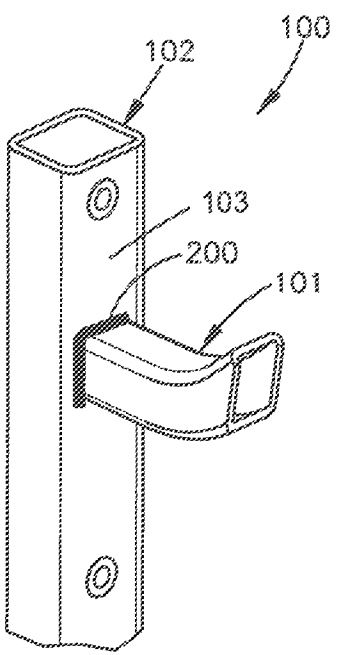
FIG. 2 is an assembled perspective view corresponding to FIG. 1 showing a first end of the angled tubular member received into the square aperture in the hollow support structure.

Throughout the drawings and the detailed description, unless otherwise described, the same drawing reference numerals will be understood to refer to the same elements, features, and structures. The relative size and depiction of these elements may he exaggerated for clarity, illustration, and convenience.

DETAILED DESCRIPTION OF THE DRAWINGS

The foregoing summary, as well as the following detailed description, will be better understood when read in conjunction with the appended drawings. For the purpose of illustration, certain embodiments of the present invention are shown in the drawings. It should be understood, however, that the invention is not limited to the precise arrangements and embodiments shown. The accompanying drawings, which are incorporated in and constitute a part of this specification, illustrate an implementation of systems, apparatuses, and methods consistent with the present description and, together with the description, serve to explain advantages and principles consistent with the invention.

The embodiments of the present invention will now be described more fully with reference to the accompanying drawings, in which preferred embodiments of the invention are shown. The following detailed description is provided to assist the reader in gaining a comprehensive understanding of the methods, apparatuses, and/or systems described herein. This invention may, however, be embodied in many different forms and should not be construed as limited to the illustrated embodiments set forth herein. Accordingly, various changes, modifications, and equivalents of the systems, apparatuses and/or methods described herein will be suggested to or understood by those of ordinary skill in the art. Also, descriptions of well-known functions and constructions may be omitted for increased clarity and conciseness.

In the following description, like reference characters designate like or corresponding parts throughout the figures. It is to be understood that the phraseology and terminology used in the following description are used for the purpose of description and enablement, and should not be regarded as limiting. Additionally, in the following description, it is understood that terms such as "top," "bottom," "side," "front," "back," "inner," "outer." and the like, are words of convenience and are not to be construed as limiting terms.

Figure 1:
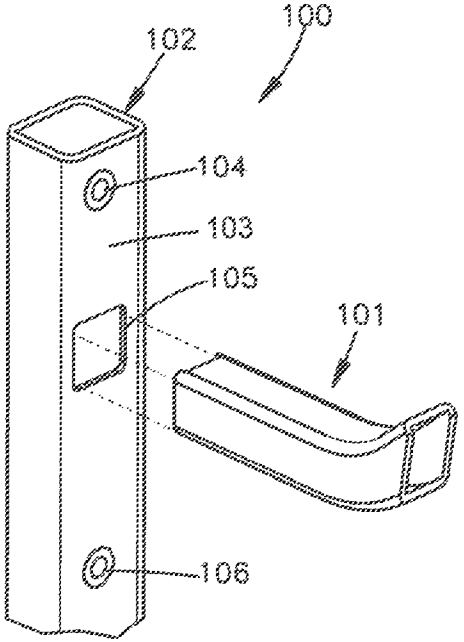
FIG. 1 is an exploded perspective view of an embodiment of the present tube rack-out system having a square hollow support structure and a square angled tubular member.

FIGS. 1 and 2 are perspective views of an embodiment of the present tube rack-out system 100 comprising a support structure 102 and an angled tubular member 101. Optionally, support structure 102 and angled tubular member 101 are both square in cross-section as illustrated. However, it is to be understood that the present system is not so limited and that other hollow rectangular shapes or non-rectangular shapes may also be used instead.

Support structure 102 may have a first exterior wall 103 which preferably has a first mount hole 104 an aperture 105 and a second mount hole 106, positioned as shown. FIG. 1 shows an exploded perspective view and FIG. 2 shows an assembled perspective view (in which a first end of angled tubular member 101 is received into aperture 105). Subsequent to its insertion, angled tubular member 101 may be held in position by welding along first weld line 200.

Figure 3:
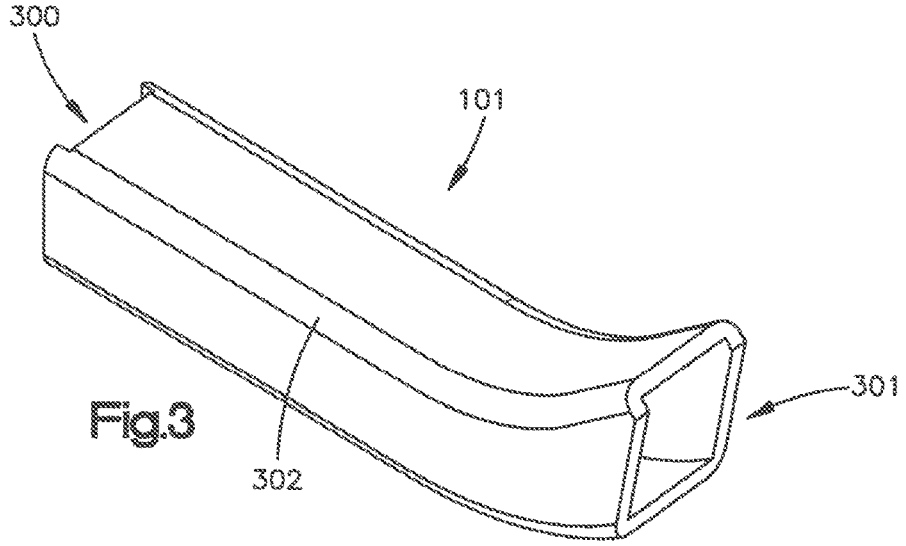
FIG. 3 is a front perspective view of the angled tubular member of FIGS. 1 and 2.
Figure 4:
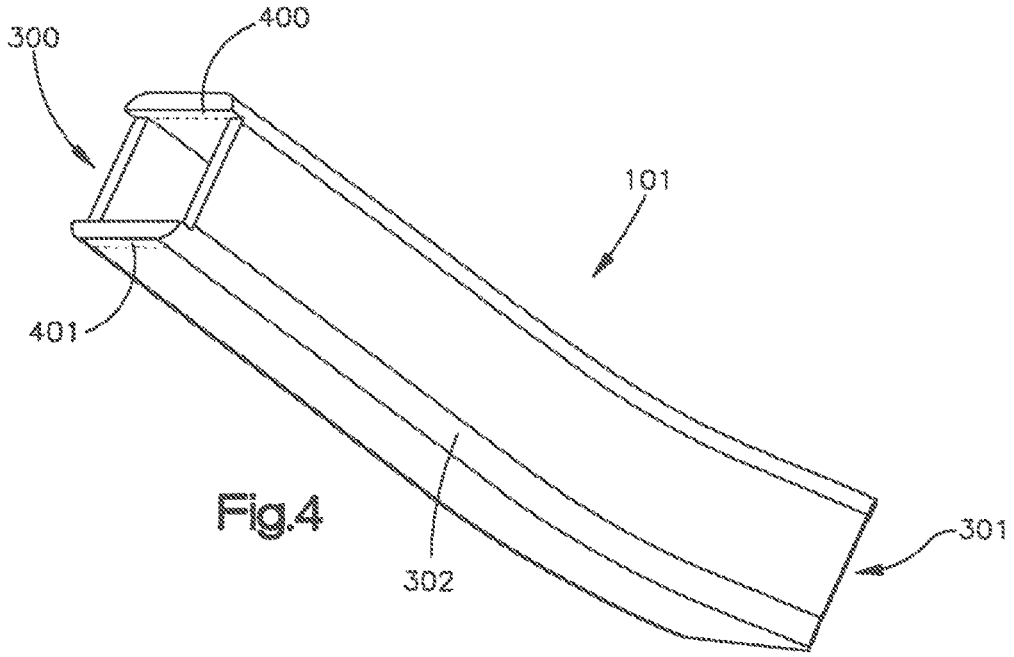
FIG. 4 is a rear perspective view of the angled tubular member of FIG. 3.

FIGS. 3 and 4 show front and rear perspective views of the angled tubular member 101 of FIGS. 1 and 2. As seen in FIG. 3, angled tubular member 101 may have a first end 300 and a second (free, angled) end 301. The first end 300 is preferably straight and may preferably extend horizontally, or perpendicular to, support structure 102. The second end 301 may bend or curved upwardly as shown such that second end 301 may be positioned higher from the ground than first end 300. It is to be understood that the angle of curvature of upwardly curved end 301 need not be exactly as shown. Specifically, the angle of curvature may be more or less than the illustrated embodiment, and the bend may be smooth and curvilinear as shown or may change direction at a more abrupt angle. Preferably as well, angled tubular member 101 may have rounded edges 302 onto which covers (701 in FIG. 7) are placed.

In preferred configurations, support structure 102 is positioned vertical to the ground and the first end 300 of angled tubular member 101 will therefore be positioned horizontal to the ground. It is to be understood, however, that the present system is not so limited. For example, support structure 102 may instead be tilted backwardly somewhat such that free end 301 of angled tubular member 101 will be positioned even higher than it would have been positioned above first end 300 if support structure 102 were simply vertical.

Figure 5B:
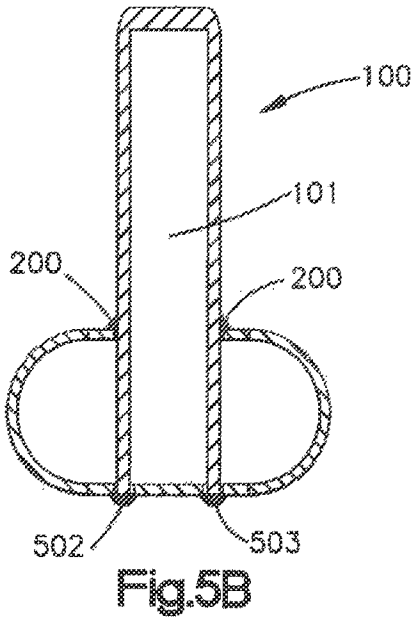
FIG. 5B is a cross-sectional top view of the embodiment of the present tube rack-out system of FIG. 5A.
Figure 5A:
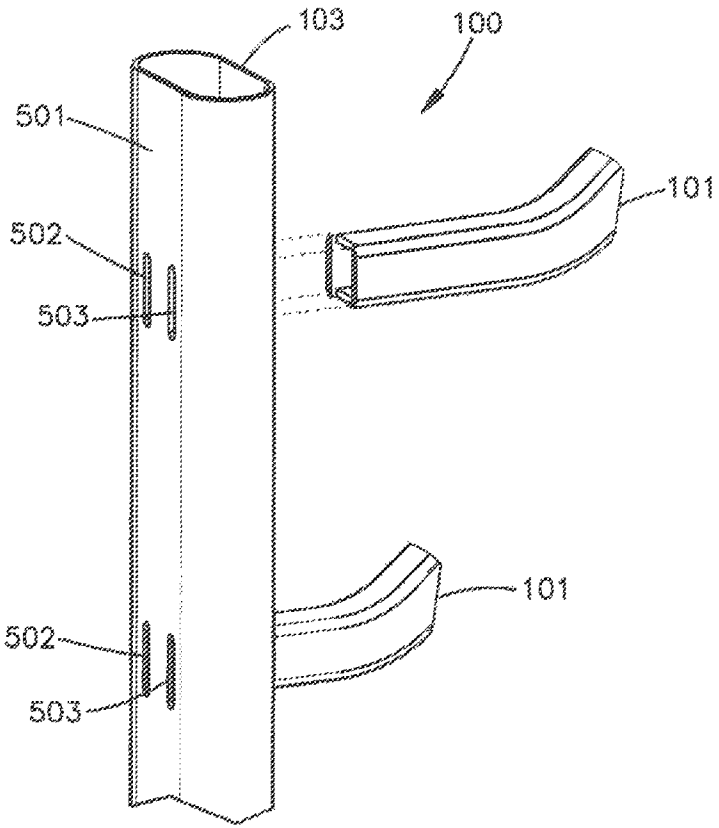
FIG. 5A is a rear perspective view of an embodiment of the present tube rack-out system showing a pair of vertical slots on the hollow support structure into which are received a pair of notches on the angled tubular member.

As seen in FIG. 4, angled tubular member 101 may also have vertical notches 400 and 401. FIG. 5A shows a pair of vertical slots 502 and 503 on support structure 102 into which vertical notches 400 and 401 can optionally be received. FIG. 5B is a cross-sectional top view also showing how vertical notches 400 and 401 (FIG. 4) can be received into vertical slots 502 and 503, respectively. As also seen in FIGS. 5A and 5B, the vertical support member can itself have a non-rectangular cross-section with opposite straight walls 301 and 501 with curved side walls therebetween. As can also be seen, subsequent to the insertion of vertical notches 400 and 401 into vertical slots 502 and 503, the first end 300 of angled tubular member 101 will be flush with the exterior of side wall 501. Optionally, welding may be performed along vertical slots 502 and 503 in order to secure angled tubular member 101 into support structure 102.

Figure 6:
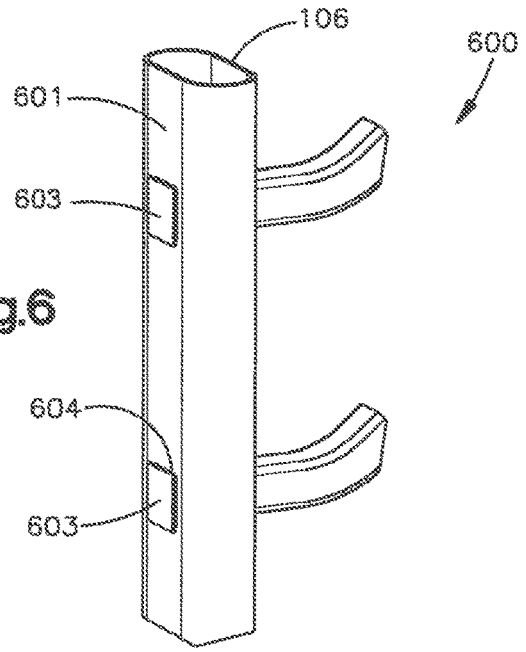
FIG. 6 is a rear perspective view of an embodiment of the present tube rack-out system having end caps over apertures in the back wall of the hollow support structure.

FIG. 6 is a rear perspective view of an alternate embodiment of the present tube rack-out system 600 having end caps 603 positioned over the apertures in the back wall 601 of the hollow support structure 106. Specifically, hollow support structure 106 may have a second aperture (not shown, found immediately behind end cap 603). In this configuration, first end 301 of angled tubular member 101 may be inserted into aperture 105 and project out of the second aperture on hollow support structure 106. Next, end cap 603 may be inserted into the open tubular end of first end 301 of angled tubular member 101, or end cap 603 may simply cover the open tubular end of first end 301 of angled tubular member 101. Optionally, end cap 603 may be welded into position along weld line 604. In other embodiments, end cap 603 may simply be a plastic insertion piece.

Figure 7:
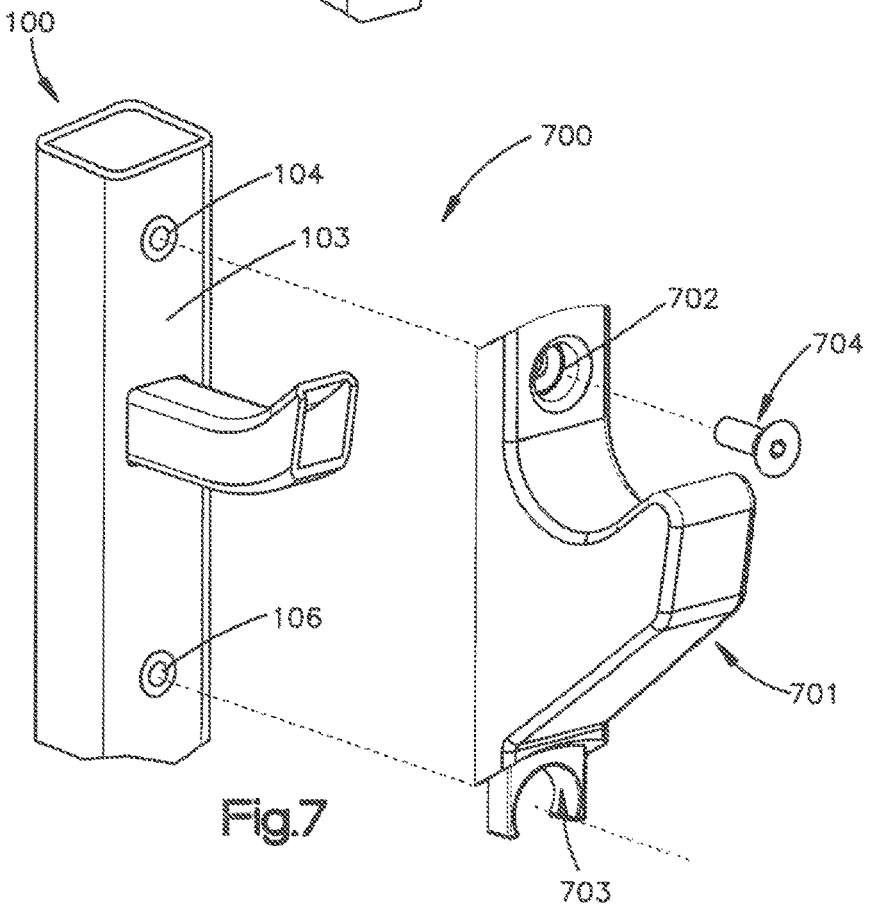
FIG. 7 is an exploded front perspective view of the present tube rack-out system showing a cover passing over the angled tubular member and attached onto the hollow support structure.

FIG. 7 is an exploded front perspective view of the present tube rack-out system 700 showing a cover 701 passing over the angled tubular member 101 and attached onto the hollow support structure 106. Cover 701 optionally has a first cover mount hole 702 and a semicircular cover mount hole 703. Cover 701 passes over the upper surface of the angled tubular member 101, and cover 701 is connected directly onto the hollow support structure 106. As can be seen, cover 701 preferably has a downwardly shaped curved portion that is received over the upwardly curved free end of angled tubular member 101. As such, when a weight bar (e.g.: barbell or a dumbbell) is placed on top of cover 701, the weight bar is fully supported by the upper surface of angled tubular member 101 immediately below cover 701. Optionally, cover 701 can be made of polyurethane, or other suitable material.

The first cover mount hole 702 may preferably align with the first mount hole 104 of the first exterior wall 103 of support structure 102. Securing mechanism 704 may be inserted through first cover mount hole 702 and first mount hole 104 to secure rack-out cover 701 to the first exterior wall 103 of support structure 102. A second, similar securing mechanism (not shown) may also be inserted through semi-circle cover mount hole 703 and second mount hole 106 to further secure rack-out cover 701 to the first exterior wall 103 of support structure 102.

In various exemplary embodiments, the cross section of the angled tubular member 101 may be a 1 inch squared cross section. However, the cross sectional shape of angled tubular member 101 is not limited thereto. For example, the cross sectional dimensions may include at least 0.5 square inches, at least 1 square inch, at least 1.5 square inches, at least 2 square inches, at least 2.5 square inches, at least 3 square inches, at most 0.5 square inches, at most 1 square inches, at most 1.5 square inches, at most 2 square inches, at most 2.5 square inches, or at most 3 square inches.

In other examples, members 101 and 106 may each have cross-sections that are rectangular, rather than a square, with sides that have at least a 1.5:1 ratio, at least a 2:1 ratio, at least a 2.5:1 ratio, at least a 3:1 ratio, at least a 3.5:1 ratio, at least a 4:1 ratio, at least a 4.5:1 ratio, at least a 5:1 ratio, at most a 1.5:1 ratio, at most a 2:1 ratio, at most a 2.5:1 ratio, at most a 3:1 ratio, at most a 3.5:1 ratio, at most a 4:1 ratio, at most a 4.5:1 ratio, or at most a 5:1 ratio.

LIST OF REFERENCE NUMERALS

100—rack-out system
101—angled tubular member
102—support structure
103—first exterior wall
104—first mount hole
105—aperture
106—second mount hole
200—first weld line
300—first end of angled tubular member
301—second end of angled tubular member
302—round edge of angled tubular member
400—first vertical notch on angled tubular member
401—second vertical notch on angled tubular member
501—second slotted exterior wall on support structure
502—first vertical slot on support structure
503—second vertical slot on support structure
600—end cap rack-out assembly
601—second exterior wall of support structure
602—second rack hole of support structure
603—end cap
604—second weld line
700—cover mounting assembly
701—rack-out cover
702—first cover mount hole of support structure
703—semicircle cover mount hole of support structure
704—securing mechanism The list of reference numerals is provided for convenience and is intended to aid understanding of the illustrated examples described above. The examples of the present invention may be described in many different forms and should not be construed as limited to the illustrated examples. Likewise, the list above setting forth the reference numerals and associated components comprising the illustrated examples do not limit the scope of the invention.

One of skill in the art will recognize that the examples described above are not limited to any particular size, and the size of the exercise machine will depend upon the particular application and intended components. It will be appreciated by those skilled in the art that changes could he made to the examples described above without departing from the broad inventive concept thereof. It is understood, therefore, that the invention disclosed herein is not limited to the particular examples disclosed, and is intended to cover modifications within the spirit and scope of the present invention.

What is claimed is:

1. A support apparatus, comprising:

a hollow support structure having an aperture therein;

an angled tubular member, the angled tubular member having a first end received into the aperture in the hollow support and a second end that is angled upwardly; and a cover passing over an upper surface of the angled tubular member, the cover being connected onto the hollow support structure, wherein the support structure has a pair of slots on a side opposite to the aperture and the angled tubular member has notches thereon that are received into the slots.

2. The apparatus of claim 1, wherein the support structure has a rectangular cross section.

3. The apparatus of claim 1, wherein the support structure is a vertical member.

4. The apparatus of claim 1, wherein the angled tubular member has a rectangular cross section.

5. The apparatus of claim 4, wherein the aperture in the support structure is rectangular.

6. The apparatus of claim 1, wherein the second end of the angled tubular member is an upwardly curved free end.

7. The apparatus of claim 6, wherein the cover has a downwardly shaped curved portion that is received over the upwardly curved free end of the tubular member.

8. The apparatus of claim 1, wherein the angled tubular member is welded into the aperture in the support structure.

9. The apparatus of claim 1, wherein the first end of the angled tubular member is perpendicular to the hollow support.

10. The apparatus of claim 1, wherein the first end of the angled tubular member is horizontal and the hollow support is vertical.

11. The apparatus of claim 1, wherein the cover is made of polyurethane.

12. A support apparatus, comprising:

a hollow support structure having an aperture therein;

an angled tubular member, the angled tubular member having a first end received into the aperture in the hollow support and a second end that is angled upwardly;

a cover passing over an upper surface of the angled tubular member, the cover being connected onto the hollow support structure; wherein the hollow support structure has a second aperture opposite the aperture; and an end cap disposed over the second aperture and connected to the first end of the angled tubular member.

* * * * *